United States Patent [19]

Oikawa et al.

[11] Patent Number: 4,797,598

[45] Date of Patent: Jan. 10, 1989

[54] ILLUMINATION APPARATUS

[75] Inventors: Katsuya Oikawa, Yokohama; Hidemi Egami, Zama; Katuo Saitor, Yokohama; Hiroshi Satomura, Hatogaya, all of Japan

[73] Assignee: Canon Kabushiki Kaisha, Tokyo, Japan

[21] Appl. No.: 61,552

[22] Filed: Jun. 15, 1987

[30] Foreign Application Priority Data

| | | | |
|---|---|---|---|
| Jun. 19, 1986 | [JP] | Japan | 61-143877 |
| Jun. 19, 1986 | [JP] | Japan | 61-94003[U] |
| Mar. 3, 1987 | [JP] | Japan | 62-48080 |
| Mar. 3, 1987 | [JP] | Japan | 62-48081 |
| Mar. 3, 1987 | [JP] | Japan | 62-48082 |

[51] Int. Cl.[4] ..... H01J 65/09; H05B 6/80

[52] U.S. Cl. ..... 315/85; 315/115; 315/117; 315/248; 315/174; 313/13; 313/15; 313/239; 355/69

[58] Field of Search ..... 315/115, 116, 117, 50, 315/248, 267, 174, 175, 344, 85; 313/15, 30, 31, 34, 607, 608, 609, 611, 634, 234, 13, 239; 355/67, 68, 69

[56] References Cited

U.S. PATENT DOCUMENTS

| | | | |
|---|---|---|---|
| 2,267,821 | 12/1941 | Elenbaas | 315/115 |
| 2,975,330 | 3/1961 | Bloom et al. | 315/115 |
| 3,323,010 | 5/1967 | Bisjak et al. | 315/115 |
| 3,331,977 | 7/1967 | Wainio | 313/34 |
| 3,807,856 | 4/1974 | Rodriquez | 355/67 |
| 4,431,947 | 2/1984 | Ferris | 315/151 |
| 4,451,765 | 5/1984 | Gray | 315/248 |
| 4,533,853 | 8/1985 | Hammond et al. | 315/115 |
| 4,533,854 | 8/1985 | Northrup | 315/115 |

*Primary Examiner*—David K. Moore
*Assistant Examiner*—Mark R. Powell
*Attorney, Agent, or Firm*—Fitzpatrick, Cella, Harper & Scinto

[57] ABSTRACT

An illumination apparatus includes a discharge tube for emitting light upon an application of an external high frequency wave electromagnetic field, an electrode, arranged outside the discharge tube, for applying the high frequency wave electromagnetic field to the discharge tube, a high frequency wave applying unit for supplying high frequency wave power to the electrode, and a projected portion extending from the discharge tube. The projected portion extends to a position where the high frequency wave electromagnetic field generated by the electrode has a level lower than a discharge initiation level. The high frequency wave power is controlled by changing a voltage, a frequency, a duty ratio or the like.

17 Claims, 16 Drawing Sheets

ILLUMINATION APPARATUS

BACKGROUND OF THE INVENTION

1. Field of the Invention

The present invention relates to an illumination apparatus for externally applying a high frequency wave electromagnetic field to a discharge tube, thereby causing light emission of the discharge tube.

More particularly, the present invention relates to an illumination apparatus suitable as a light source for original exposure in an original reading system.

2. Related Background Art

Fluorescent and halogen lamps have been very popular as conventional illumination apparatuses for original exposure in original reading systems or the like.

The fluorescent lamp emits a small quantity of light and is used as a conventional illumination apparatus for a low-speed original reading system. If the fluorescent lamp is used as an illumination apparatus for a high-speed original reading system by increasing power supply and brightness (i.e., the quantity of emission light), a filament arranged inside the fluorescent tube is melted. Therefore, the level of power supplied to the fluorescent lamp is limited, and the fluorescent lamp is not suitable for a high-speed original reading system.

The halogen lamp has a large quantity of emission light and has been used in an original reading system. However, the halogen lamp generates infrared rays having wavelengths outside the wavelengths of visible light range required for reading the original. Power consumption of the halogen lamp is large, and luminous efficiency thereof is low. In addition, the infrared rays generate heat, which requires a cooling unit, and in particular, a large cooling unit. Therefore, the halogen lamp is not suitable as a compact, inexpensive, low-power consumption illumination apparatus.

The present inventors have already proposed illumination apparatuses for generating a large quantity of emission light in the visible light range so as to solve the above problem, as disclosed in copending U.S. patent application Ser. Nos. 944,863 and 942,833.

As shown in FIGS. 6 and 7, each illumination apparatus of U.S. Ser. Nos. 944,863 and 942,833, comprises a discharge tube 1 for emitting light in response to a high frequency electromagnetic field, electrodes 2 mounted on the outer wall surface of the discharge tube 1, and a high frequency wave applying means 3 for applying a high frequency wave to the electrodes 2.

In a conventional illumination apparatus for causing the discharge lamp to emit light upon an external application of a high frequency wave electromagnetic field to the charge tube, high power can be applied to the electrodes. In addition, such an illumination apparatus is suitable as an exposure light source in an original reading system so as to primarily generate light in the visible range.

However, in this illumination apparatus, ultraviolet rays caused by oxidation of a discharge initiator such as mercury inside the discharge tube serves as a light emission source. If a temperature in the discharge tube varies, the vapor pressure of the discharge initiator gas and hence luminous efficiency of ultraviolet rays is changed. As a result, luminous efficiency varies.

The present inventors found that the quantity of emission light varied if variations in luminous efficiency caused changes in temperature of the discharge tube.

SUMMARY OF THE INVENTION

It is an object of the present invention to provide an illumination apparatus wherein the quantity of emission light does not vary even if a change in temperature of a discharge tube occurs.

It is another object of the present invention to provide an illumination apparatus wherein stable lighting initiation can be achieved regardless of changes in circumferential temperature.

The above and other objects, features and advantages of the present invention will be apparent from the following detailed description taken in conjunction with the accompanying drawings.

DESCRIPTION OF THE PREFERRED EMBODIMENTS

Figure 1:
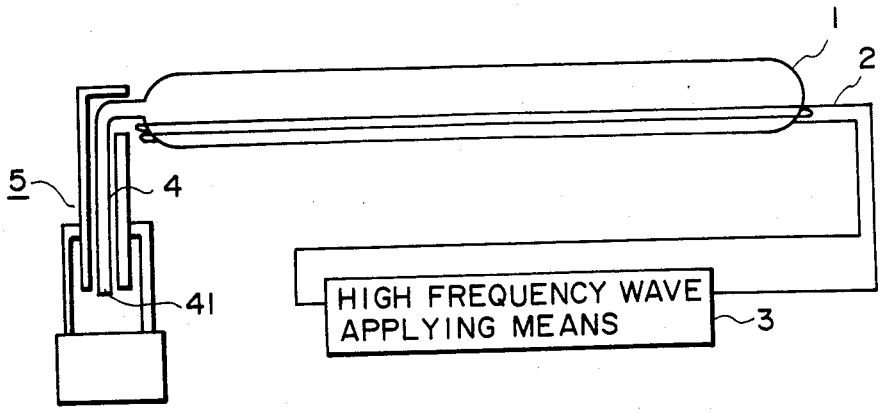
FIG. 1 is a schematic view showing an arrangement of an illumination apparatus according to an embodiment of the present invention.

Preferred embodiments of the present invention will be described with reference to the accompanying drawings.

The same reference numerals denote the same parts throughout the specification.

FIG. 1 is a schematic view showing an illumination apparatus according to an embodiment of the present invention. A discharge tube 1 comprises an elongated glass tube made of soda glass or pyrex. A phosphor is applied to the inner surface of the glass tube. A discharge initiator such as mercury and an inert gas such as Ar are sealed in the discharge tube 1. An electrode 2 is constituted by winding a conductor on the discharge tube 1 a plurality of times along the longitudinal direction of the tube. The conductor is exemplified by copper or stainless steel subjected to minimal oxidation. The electrode may be slightly separated from the outer wall surface of the discharge tube 1 but is preferably brought into direct contact with the outer wall surface of the discharge tube so as to minimize power loss acting on the discharge tube 1.

A high frequency wave voltage is applied from a high frequency wave applying means 3 to the electrode 2. When the high frequency wave voltage is actually applied from the high frequency wave applying means 3 to the electrode 2, the mercury gas in the discharge tube 1 is excited by the high frequency wave electromagnetic field to generate ultraviolet rays. The ultraviolet rays impinge on the phosphor layer formed on the inner surface of the discharge tube, thereby generating light in the visible range.

A projected portion 4 extending from the discharge tube 1 has a distal end 41. When the discharge tube 1 is lit, the distal end 41 serves as a portion where the intensity of the high frequency wave electromagnetic field generated by the high frequency wave voltage applied to the electrode 2 is weakened below the discharge initiation intensity. In other words, the distal end 41 serves as a portion which tends not to be influenced by any temperature rise caused by the high frequency electromagnetic field and is thus spaced apart from a light-emitting portion where the high frequency wave electromagnetic field is concentrated. More specifically, the distal end 41 of the projected portion 4 is prepared such that the diameter of the tube is decreased to several mm and this small-diameter portion is extended from one discharge tube end by 50 to 100 mm and is bent in an L shape. Since the projected portion 4 is constituted by the small-diameter portion, ions and electrons tend not to be moved in the projected portion 4 when the discharge tube 1 is lit. A small-diameter portion may extend from the center of the discharge tube 1 in a direction perpendicular to the axis of the tube 1 so as to constitute a T-shaped structure, or a U-shaped small-diameter portion may be used within the range of conditions determined by installation conditions of the illumination apparatus.

Variations in quantity of light which are caused by temperature changes depend on variations in saturated vapor pressure. Since the portion 4 projected from the discharge tube 1 is formed integrally with the tube, the saturated vapor pressure inside the discharge tube 1 is determined by the saturated vapor pressure inside the projected portion 4. Therefore, variations in quantity of light can be greatly reduced.

A temperature adjusting means 5 is connected to the projected portion 4. The discharge initiator atoms such as mercury atoms are exited by the high frequency wave electromagnetic field generated by the high voltage having a frequency of 1 MHz to 102 MHz, a voltage Vpp of 200V or higher and a duty ratio of 5 to 90% and applied from the high frequency wave applying means 3 to the electrode 2. The ultraviolet rays (primarily a wavelength of 253.7 nm) are generated. The ultraviolet rays impinge on the phosphor layer to emit light in the visible range.

The temperatures of the discharge tube 1 and the gases inside the tube 1 are increased by the high frequency wave electromagnetic field generated by the electrode 2. When the saturated vapor pressure of the discharge initiator is changed, the quantity of ultraviolet emission from the discharge initiator gas is changed. Therefore, the quantity of visible light emitted from the phosphor is accordingly changed. A curve representing a change in light quantity is an inverted U-shaped curve having a vertex between 30° C. and 50° C. The change in light quantity appears as a function of the change in temperature of the wall of the discharge tube 1. The temperature of the outer wall surface of the discharge tube at a portion where the high frequency wave electromagnetic field is concentrated is very high. More specifically, the temperature of the light-emitting portion at which the high frequency wave electromagnetic field is concentrated reaches 200° C. or higher. If the discharge tube does not have a projected portion, this temperature rise decreases the quantity of light. However, in the discharge tube with the projected portion according to this embodiment, the saturated vapor pressure is determined by the temperature of the portion 4 projected from the discharge tube 1. The mercury vapor pressure can be determined by the projected portion 4 which receives the least influence of temperature changes. As a result, changes in quantity of light are small. More preferably, the portion having the lowest temperature can be maintained at a temperature (between 30° C. and 50° C.) for obtaining a maximum quantity of emission light. Therefore, a larger quantity of emission light can be obtained by temperature adjustment without decreasing the quantity of light.

Figure 2:
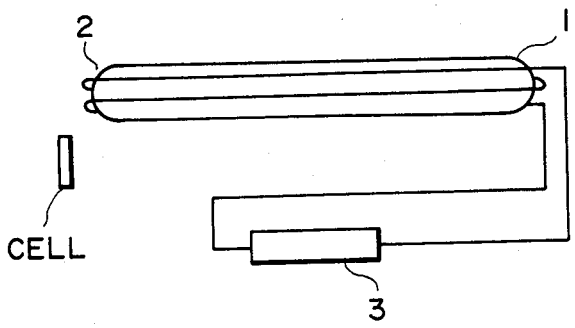
FIG. 2 is a schematic view for explaining the principle of the present invention.

In the discharge tube in the illumination apparatus according to this embodiment, the intensity of the high frequency wave electromagnetic field generated by the high frequency wave voltage applied to the electrode 2 is very low at the L-shaped projected portion 4 in the discharge tube 1. As shown in FIG. 2, even if an independent discharge cell having the same shape as the projected portion 4 and sealing therein an inert gas (e.g., Ar) and a discharge initiator (e.g., mercury), both of which have the same compositions and pressures as those in the discharge tube 1, is used, electric discharging does not occur in the discharge cell during operation of the discharge tube 1, since it is not in a position to receive a sufficient electromagnetic field. The projected portion 4 is preferably disposed at a position where the high frequency wave electromagnetic field intensity is set below the discharge initiation intensity during normal lighting of the discharge tube. In the discharge tube 1 (FIG. 1) having an integral projected portion 4, even when the projected portion 4 is disposed at a position where the high frequency wave electromagnetic field intensity is set below the discharge initiation intensity during normal lighting of the discharge tube 1, the ions and electrons in the discharge tube cause an electromagnetic field distribution during lighting of the large-diameter discharge tube 1. As a result, electrons leak from the large-diameter discharge tube 1 to the small-diameter projected portion 4, and weak emission occurs in the discharge tube 1. However, this emission differs from that caused by discharging when the high frequency wave electromagnetic field generated in cooperation with the electrode 4 by the gases in the projected portion 4 exceeds the discharge initiation intensity and discharging continues. Therefore, the temperature increase of the light-emitting portion by the above emission is very small. The emission at the projected portion 4 is caused by discharging mainly induced by electron mobility inside the discharge tube 1. The emission at the projected portion 4 is assumed not to cause rapid temperature rise of the gases unlike in discharging accompanying electron and ion behavior of the large-diameter discharge tube 1 upon an application of the high frequency wave electromagnetic field, the intensity of which exceeds the discharge initiation intensity. The projected portion 4 does not receive heat from the light-emitting portion heated to a high temperature due to a low heat conductivity of the discharge tube material. The temperature of the projected portion 4 is therefore substantially the same as the ambient or circumferential temperature. As a result, the projected portion 4 serves as a portion having a lowest temperature lower than that of the tube. When the temperature of the projected portion 4 is adjusted to a temperature (preferably 30° C. to 50° C.) higher than room temperature, the quantity of light from the discharge tube can be accurately adjusted, operation stability can be achieved, and the peak quantity of light can be obtained.

Figure 3:
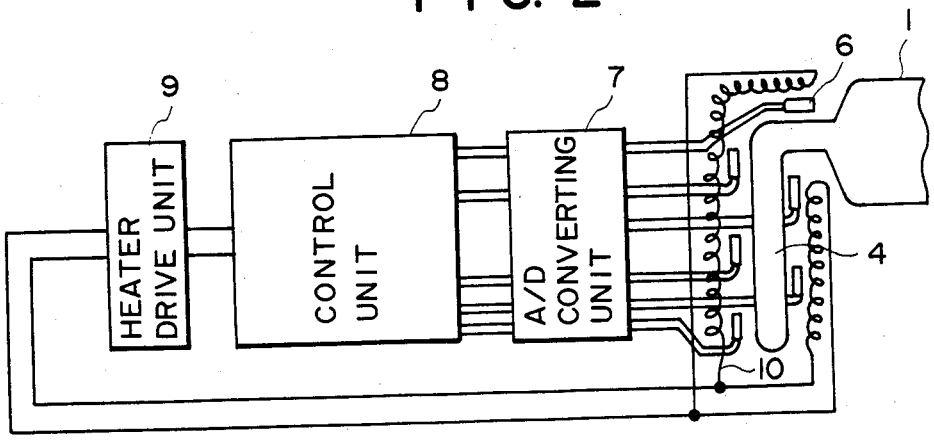
FIG. 3 is a block diagram of a temperature adjusting means 5 shown in FIG. 1.

Control for the lowest temperature (coldest point) is performed by the temperature adjusting means 5. As shown in FIG. 3, the temperature adjusting means 5 comprises temperature detecting units 6 such as thermistors for generating electrical signals in response to a plurality of temperatures, an analog-to-digital (A/D) converting unit 7 for converting analog signals from the temperature detecting units 6 into digital signals, a control unit 8, a heating unit 10 such as a heater, and a heater drive unit 9 for driving the heating unit 10. The temperature detecting units 6 are arranged to surround the projected portion (the portion having the lowest temperature) 4 of the discharge tube 1 and generate electrical signals corresponding to the detected temperatures. Each analog signal is converted into a digital signal by the A/D converting unit 7. The control unit 8 compares a plurality of digital signals from the temperature detecting units 6 through the A/D converting unit 7 and selects a signal representing a minimum temperature (lowest temperature). The control unit 8 then compares the signal representing the minimum temperature with a reference temperature for giving a maximum quantity of light. A signal representing a difference between the minimum and reference temperatures is supplied to the heater drive unit 9. The heating unit 10 is arranged to extend over the entire area of the lowest temperature portion and is driven by the heater driving unit 9. A discharge tube temperature for giving the discharge initiator vapor pressure for causing the gas to emit light with the maximum quantity of light is given between 30° C. and 50° C. (about 37° C. in this embodiment in FIG. 16). Since this temperature is normally higher than room temperature, the projected portion 4 is cooled by atmospheric air (heat dissipation). With the above arrangement according to this embodiment, since forced cooling is not performed, no cooling unit is used. The number of output factors is reduced in temperature adjustment to simplify the adjustment method. Therefore, the temperature adjusting means can be simplified.

In the above description, the reference temperature set in the control unit is determined to obtain the maximum quantity of light. However, the quantity of light can be adjusted by setting the reference temperature at a temperature higher than room temperature.

Figure 4:
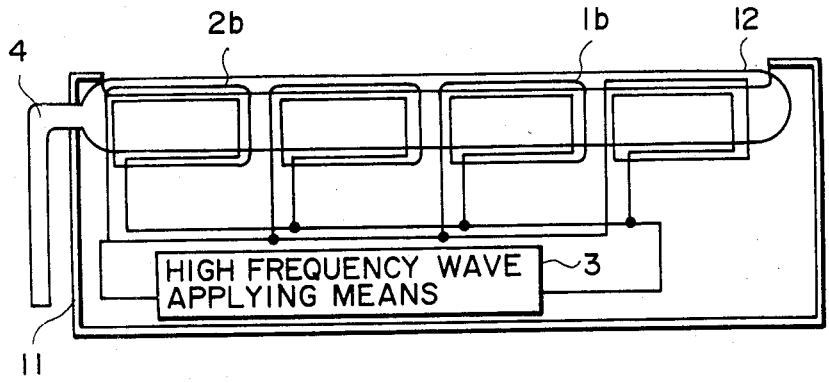
FIGS. 4 and 5 are schematic views of illumination apparatuses according to other embodiments of the present invention, respectively.

FIG. 4 shows an illumination apparatus according to another embodiment of the present invention. A discharge tube **1*b* comprises an aperture type elongated tube for increasing the quantity of light. The discharge tube 1*b* has a nonphosphor portion with a small width along the longitudinal direction thereof. A light-emitting portion is arranged inside a metal vessel 11. A small-diameter projected portion 4 is disposed outside the metal vessel, i.e., in the outer atmosphere. One or a plurality of electrodes 2*b* are arranged with respect to the discharge tube 1*b*. Each electrode 2*b* is prepared by winding a conductive wire a plurality of turns into a coil. A high frequency voltage applied to the same high frequency wave applying means as that in FIG. 1 is applied to the electrodes 2*b*. The high frequency wave applying means 3 is entirely or partially housed in the metal vessel 11. However, the high frequency wave applying means 3 may be arranged outside the metal vessel 11. Light is emitted from the discharge tube 1*b* to the outer atmosphere through a window 12 of the metal vessel 11**.

With the above arrangement, the high frequency wave electromagnetic field generated near the electrodes **2*b* are shielded by the metal vessel 11 arranged between the projected portion 4 and the electrodes 2*b* and does not reach the projected portion 4 of the discharge tube 1*b***.

In the embodiment shown in FIG. 4, the projected portion 4 of the discharge tube 1 is separated from the high frequency wave electromagnetic field applying portion, and temperature rise by the high frequency wave electromagnetic field can be further prevented as compared with the arrangement of FIG. 1. A thermal coupling between the light-emitting portion of the discharge tube lb and the atmospheric air flow is prevented. Therefore, the temperature of the portion having the lowest temperature in the discharge tube is set to the circumferential temperature. In this case, the temperature adjusting mean can be omitted. Temperature adjustment of the portion having the lowest temperature can be performed by the circumferential temperature (i.e., room temperature). With this arrangement, the high frequency wave electromagnetic field generated by the metal vessel can be shielded, and high frequency noise to the external atmosphere can be reduced. In addition, in the embodiment of FIG. 4, as compared with the electrode 2 prepared by winding the wire on the discharge tube along the longitudinal direction thereof, each electrode 2 has a small width along the longitudinal direction of the discharge tube **1*b*. In particular, a space inside the metal vessel can be omitted in a connecting portion between the small-diameter projected portion 4 of the discharge tube 1*b* and the large-diameter portion. The projected portion 4 can be exposed outside the vessel 11 from the connecting portion between the large- and small-diameter portions. The volume of the projected portion 4 of the discharge tube 1 outside the vessel 11**.is increased. Therefore, the discharge tube 1*b* can be shielded from the high frequency electromagnetic field and the projected portion 4 of the discharge tube can be located in an equilibrium state with the circumferential or ambient temperature.

Figure 5:
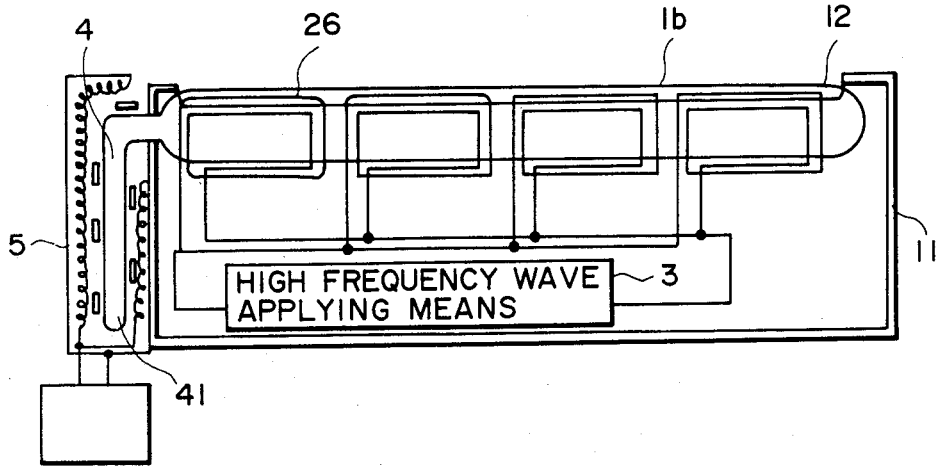
Figure 6:
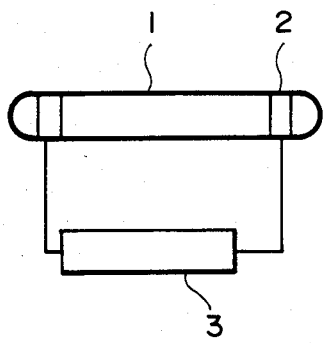
FIGS. 6 and 7 are views for explaining the background art of the present invention.
Figure 7:
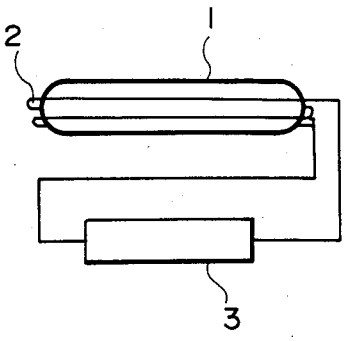

FIG. 5 shows still another embodiment of the present invention. An illumination apparatus in FIG. 5 is prepared such that a temperature adjusting means 5 is provided to the projected portion 4 exposed outside the metal vessel 11 in FIG. 4. The structure of FIG. 5 tends not to receive an external temperature influence as compared with the structure of FIG. 4. As compared with the embodiment shown in FIG. 1, high-precision temperature adjustment at the projected portion in the discharge tube can be improved. In addition, high frequency noise leakage outside the apparatus can be reduced.

In each of the above embodiments, the electrode is prepared by winding a conductive wire in a coil shape. However, the present invention is also applicable to an illumination apparatus having metal electrodes formed at the both ends of the discharge tube.

Figure 8:
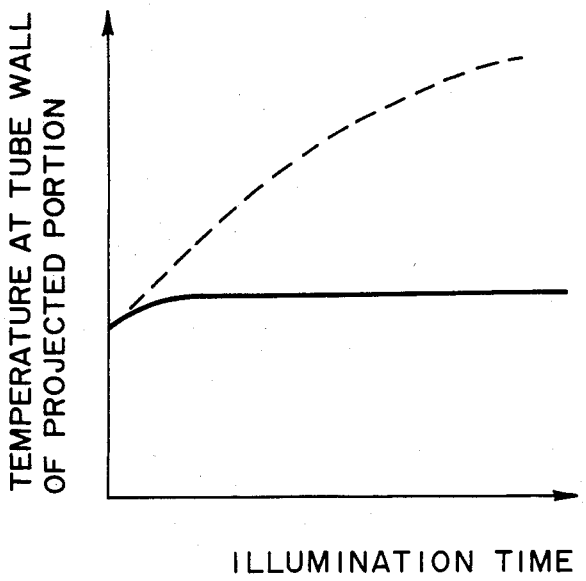
FIG. 8 is a graph showing a change in temperature at a projected portion.
Figure 11:
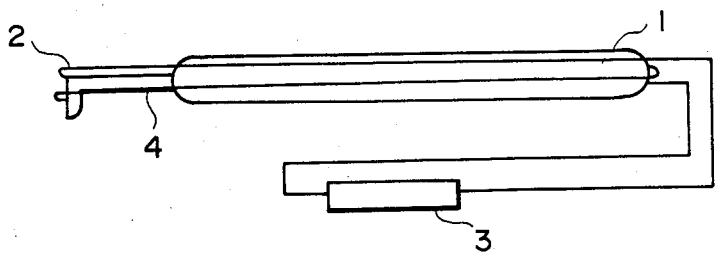
FIG. 11 is a view for explaining an arrangement of an illumination apparatus having a discharge tube projected portion in an electrode coil.

FIG. 8 is a graph showing a comparison between the tube wall temperatures of the projected-portion of the illumination apparatus in FIG. 1 and of an illumination apparatus (FIG. 11) having a minimum temperature point of the discharge tube which is located at a position where the. high frequency wave electromagnetic field intensity is higher than the discharge initiation intensity. The projected portion (FIG. 1) located at a position where the high frequency wave electromagnetic field intensity is lower than the discharge initiation intensity, as indicated by the solid line (FIG. 8), is not subjected to temperature rise and serves as a portion having the lowest temperature. A broken curve in FIG. 8 shows a case of the illumination apparatus in FIG. 11.

Figure 9:
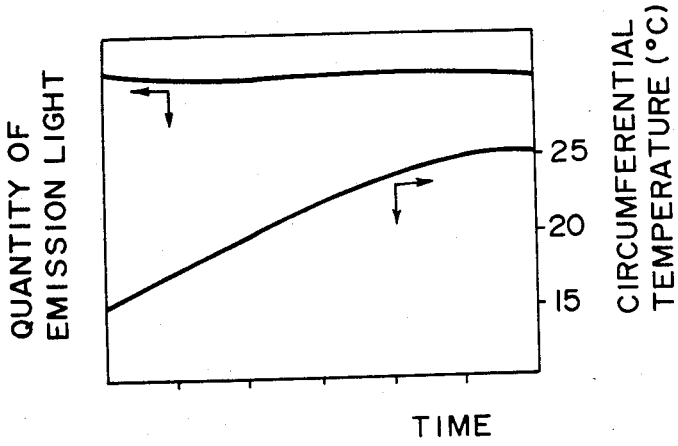
FIG. 9 is a graph showing the quantity of emission light when circumferential temperature is changed.

FIG. 9 is a graph showing changes in room temperature and changes in light quantity emitted from the illumination apparatus having the arrangement shown in FIG. 5. The quantity of light becomes constant regardless of changes in room temperature, thereby achieving stable emission regardless of changes in circumferential or ambient temperature.

Figure 10:
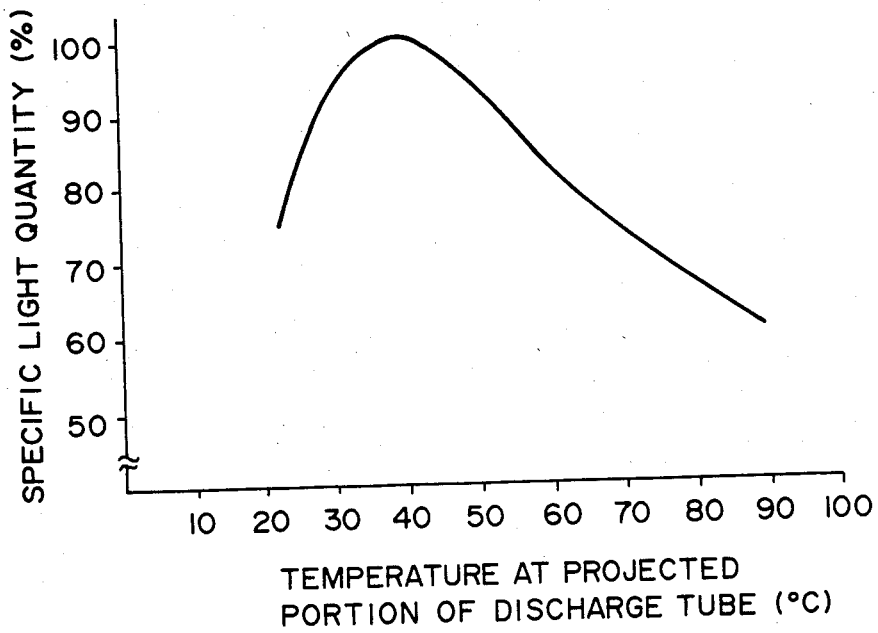
FIG. 10 is a graph showing changes in emission light when the temperature of the projected portion of the discharge tube is changed.

FIG. 10 shows changes in light quantity when the temperature of the portion having the lowest temperature in the discharge tube in the illumination apparatuses having the schematic arrangements shown in FIGS. 1 and 5 changes. Changes in minimum temperature in the range of 30° C. to 50° C. allow changes in specific light quantity (i.e., percentage of a ratio-of actual quantity of light to the maximum light quantity) of 60% to 100%. Therefore, an effect of emission quantity control by controlling the minimum temperature above room temperature (20° C. to 30° C.) is obtained. By maintaining the temperature at the reference value having an emission quantity peak in the range of 30° C. to 50° C., the maximum quantity of light can be always maintained.

In the illumination apparatuses having the arrangements shown in FIGS. 4 and 5, external high frequency noise leakage can be reduced, as described above.

Figure 12:
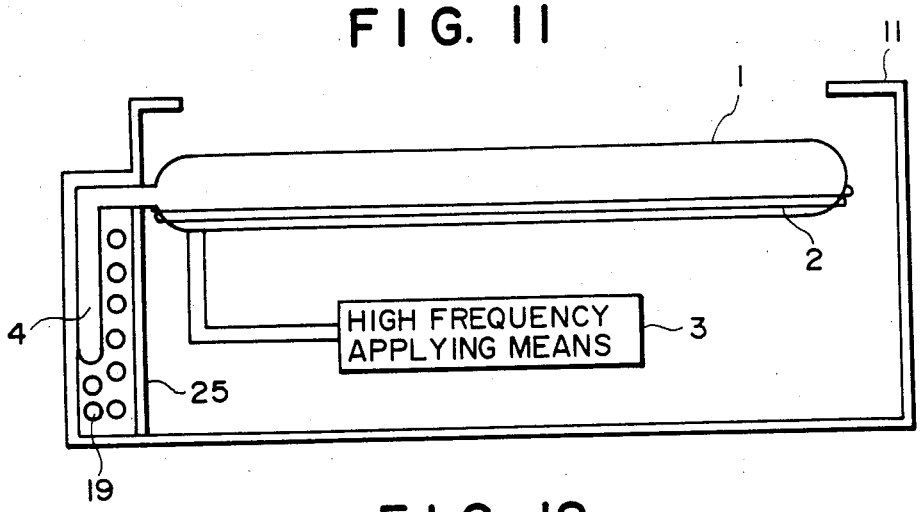
FIGS. 12 and 13 are views for explaining an illumination apparatus according to still other embodiments of the present invention, respectively.

FIG. 12 shows still another embodiment of the present invention. A projected portion 4 may be disposed inside a conductive shield 11. In this case, the projected portion 4 in the discharge tube is in direct contact with the inner wall of the shield housing. Since the shield housing material is a conductor, it has a high heat conductivity. If the projected portion of the discharge tube is heated, heat can be immediately dissipated through the shield member. Thus the projected portion can be maintained at a temperature close to the ambient temperature.

In order to improve a cooling effect of an area where the projected portion of the discharge tube is located, a plurality of small openings areformed in the shield housing to allow easy air flow through the openings.

Furthermore, the projected portion of the discharge tube is spaced apart from the high frequency wave applying means and the electrode, both of which serve to generate an electromagnetic field in the shield housing. The projected portion is also isolated by a shield 25 from the electromagnetic field generated by the high frequency wave applying means and the electrode.

The temperature rise of the gases in the projected portion 4 by the electromagnetic field can be prevented.

Still another preferred embodiment will be described in which lighting and, in particular, initial lighting can be stabilized regardless of the circumferential or ambient temperature.

Figure 13:
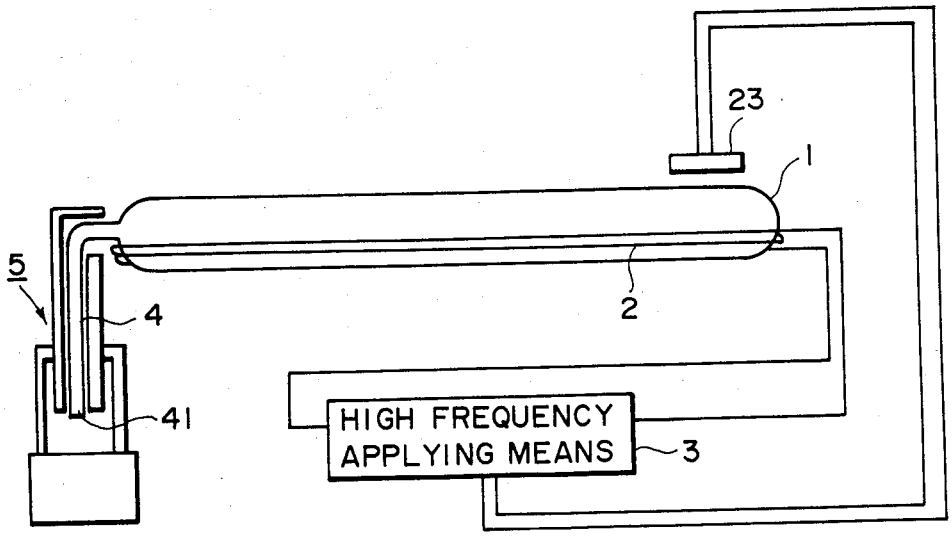

FIG. 13 shows this embodiment. A temperature sensing element 23 for detecting a temperature of a discharge tube 1 is added to the arrangement of Fi. 1. High frequency wave power applied to the electrode is controlled in response to a detection signal from the temperature sensing element 23.

A case will be described wherein the circumferential temperature is higher than that of the projected temperature.

In the same manner as in FIG. 1, the projected portion 4 is adjusted to the reference temperature of 30° C. to 50° C. The mercury vapor pressure depends on the temperature of the projected portion 4 even if the discharge tube temperature is high. Therefore, a stable lighting state with a large quantity of light and smooth initial lighting can be achieved.

A case will be described wherein the circumferential temperature is lower than that of the projected temperature.

When the circumferential temperature is low at the time of initial lighting and the outer wall temperature of the discharge tube 1 is lower than that of the projected portion 4, the quantity of emission light is determined by the saturated vapor pressure corresponding to the minimum temperature inside the discharge tube 1. The maximum quantity of emission light is not determined by the projected portion 4 whose temperature is controlled to be the reference value (normally 30° C. to 50° C.) for providing the maximum quantity of light of the discharge tube, but by the tube wall temperature (lower than the temperature of the projected portion 4) of the discharge tube 1.

Until the temperature of the discharge tube is increased to the temperature of the projected portion upon lighting of the discharge tube, the quantity of emission light varies.

In this embodiment, the tube wall temperature is monitored by the temperature sensing element 23 at the time of a standby state of the illumination apparatus. If the temperature detected by the element 23 is lower than that of the projected portion 4, pre-heating is performed to increase the tube wall temperature of the discharge tube 1 to the temperature of the projected portion 4 or higher. In pre-heating, high frequency wave power is applied to the electrode for a predetermined period of time or until the tube temperature reaches a predetermined temperature.

The mercury vapor pressure then depends on the temperature of the projected portion regardless of the circumferential temperature, thereby maintaining stable light emission.

The high frequency wave power applied to the electrode in pre-heating may have a level equal to or higher than that of stable lighting of the discharge tube. However, in order to prevent degradation or the like of the phosphor in the discharge tube, the level of power is lower than that in stable lighting, and preferably a level at which the discharge tube is not lit.

The presence/absence of pre-heating and changes in high frequency wave power in pre-heating and tube discharging are determined by changes in voltage, frequency, duty ratio, or any combination thereof.

An arrangement for changing a high frequency voltage will be described below.

Figure 14:
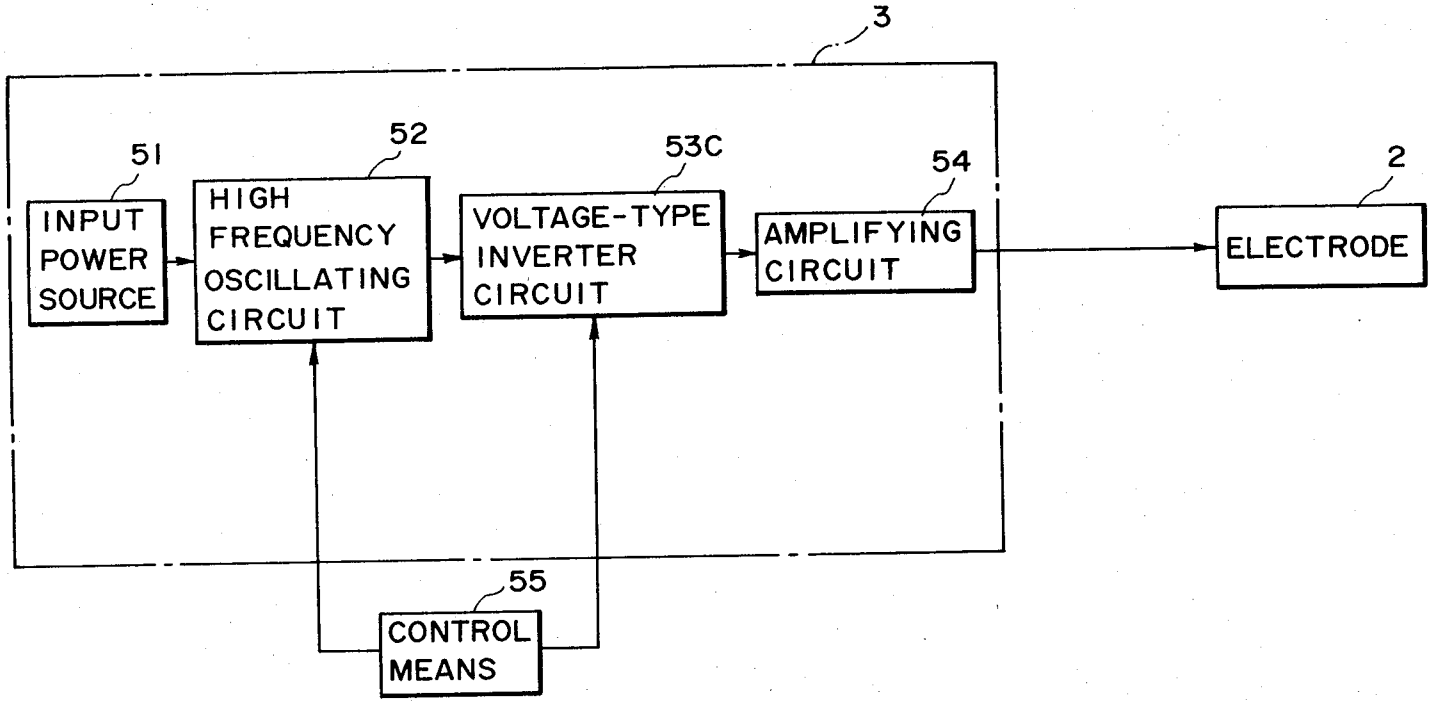
FIG. 14 is a block diagram showing an arrangement of a high frequency voltage changing circuit.
Figure 15:
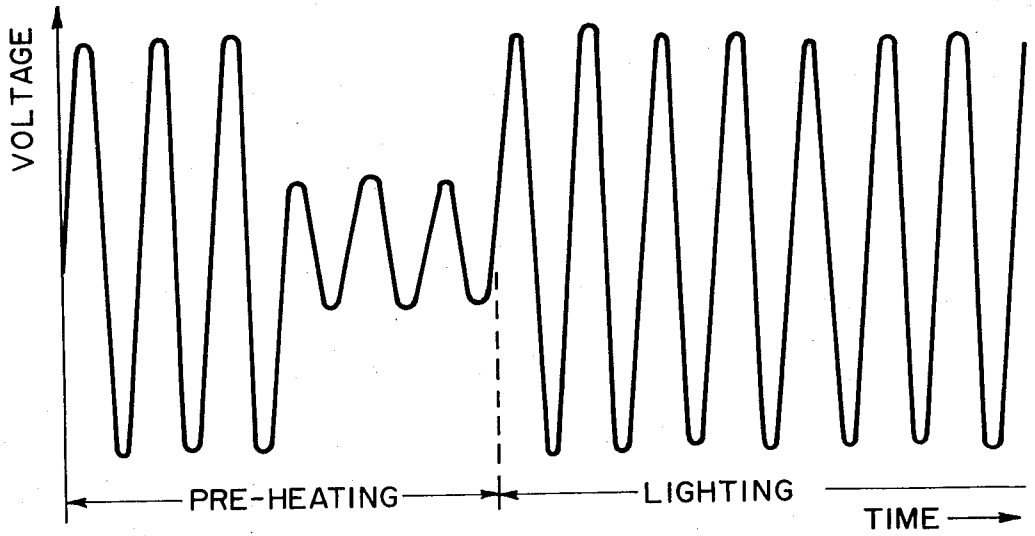
FIG. 15 is a waveform chart of the circuit shown in FIG. 14.

In an arrangement of FIG. 14, a bridge voltage-type inverter circuit 53C having a PWM function known to those skilled in the art is arranged between a high frequency oscillating circuit 52 for receiving power from an input power source 51 and an amplifying circuit 54 in the high frequency wave applying circuit 3. The inverter circuit 53C is controlled by a control means 55 such as a microprocessor together with the high frequency oscillating circuit 52. As shown in FIG. 15, a high frequency wave voltage having the same level as that in stable lighting of the tube is applied to the electrode to pre-heat the tube wall to the temperature of the projected portion 4. Thereafter, a low voltage (the discharge tube is not lit) is applied to the electrode.

In this state, when a lighting signal is input, a high frequency wave voltage enough to discharge the discharge tube 1 is applied to the electrode 2. Therefore, the discharge tube 1 is lit. In this case, before and after lightig of the discharge tube 1, since the portion having the lowest temperature in the tube wall temperatures of the discharge tube 1 is set to be that of the projected portion 4, the quantity of emission light during lighting of the discharge tube is determined by the temperature of the projected portion 4.

Figure 16:
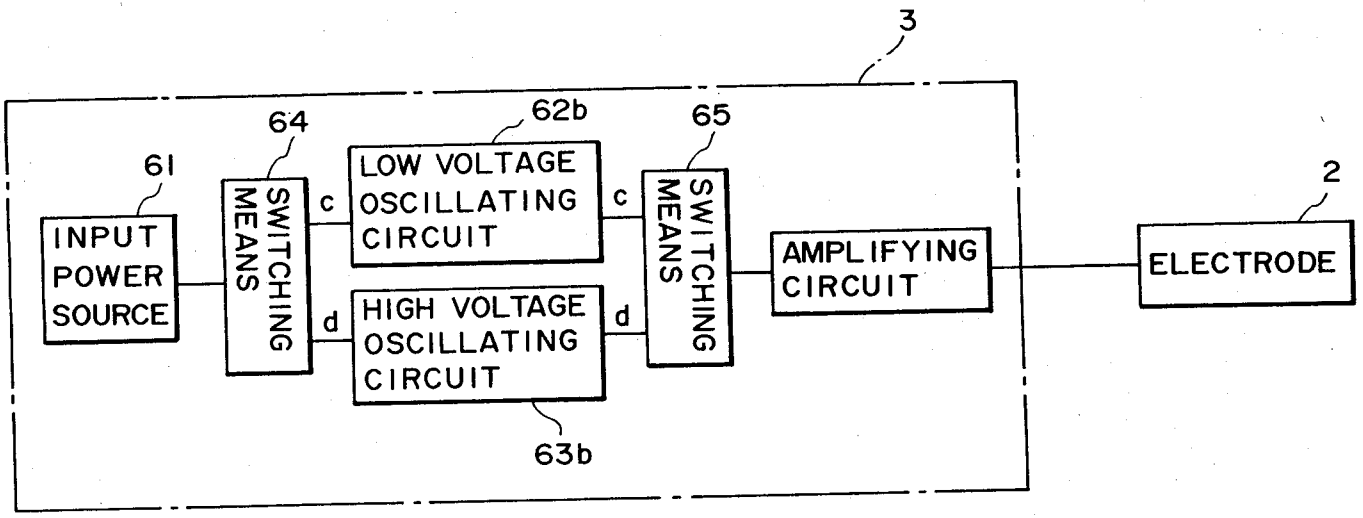
FIG. 16 is a block diagram showing another arrangement of the high frequency voltage changing circuit.
Figure 17:
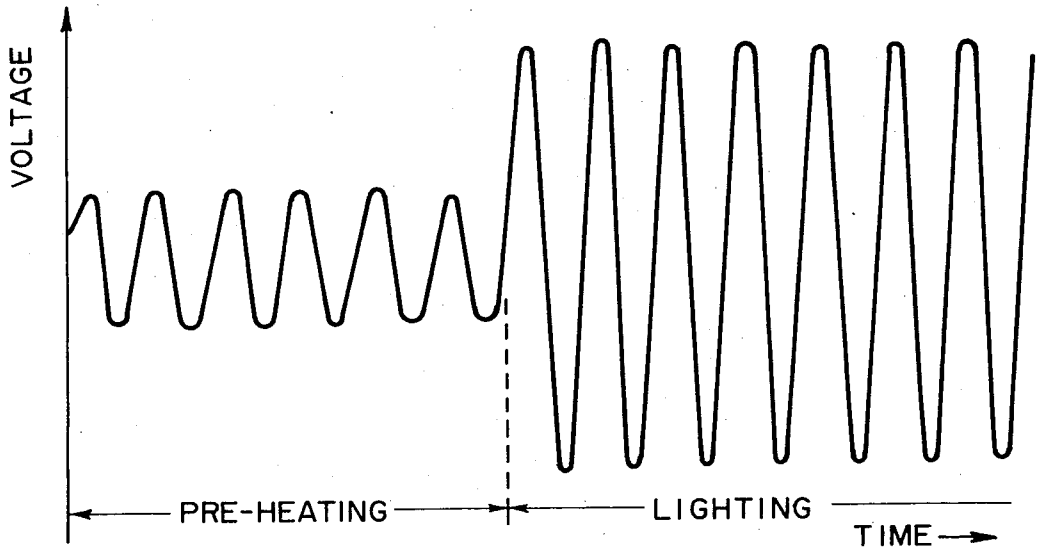
FIG. 17 is a waveform chart for explaining the operation of the circuit shown in FIG. 16.

In the above description, the voltage-type inverter circuit 53C is controlled to vary the high frequency wave voltage to a predetermined voltage, thereby performing pre-heating. However, as shown in FIG. 16, the high frequency wave applying means 3 may comprise a low voltage oscillating circuit **62*b* and a high voltage oscillating circuit 63*b*, a switching means 64 connected to the inputs of the oscillating circuits 62*b* and 63*b*, a switching means 65 connected to the outputs of the oscillating circuits 62*b* and 63*b*, an input power source 61 connected to the input of the switching means 4, and an amplifying circuit connected to the output of the switching means 65. As shown in FIG. 17, in the preheating mode, a transmission path c on the side of low voltage oscillating circuit 62*b* is enabled. However, in lighting of the discharge tube, a transmission path d on the side of the high voltage oscillating circuit 63*b* is enabled. When the low voltage is applied to the electrode 2 in the pre-heating mode, the application time is prolonged as compared with the case of FIG. 15**. However, the discharge tube is not accidentally lit in the standby mode.

An arrangement for changing the high frequency wave power by frequency will be described.

Figure 18:
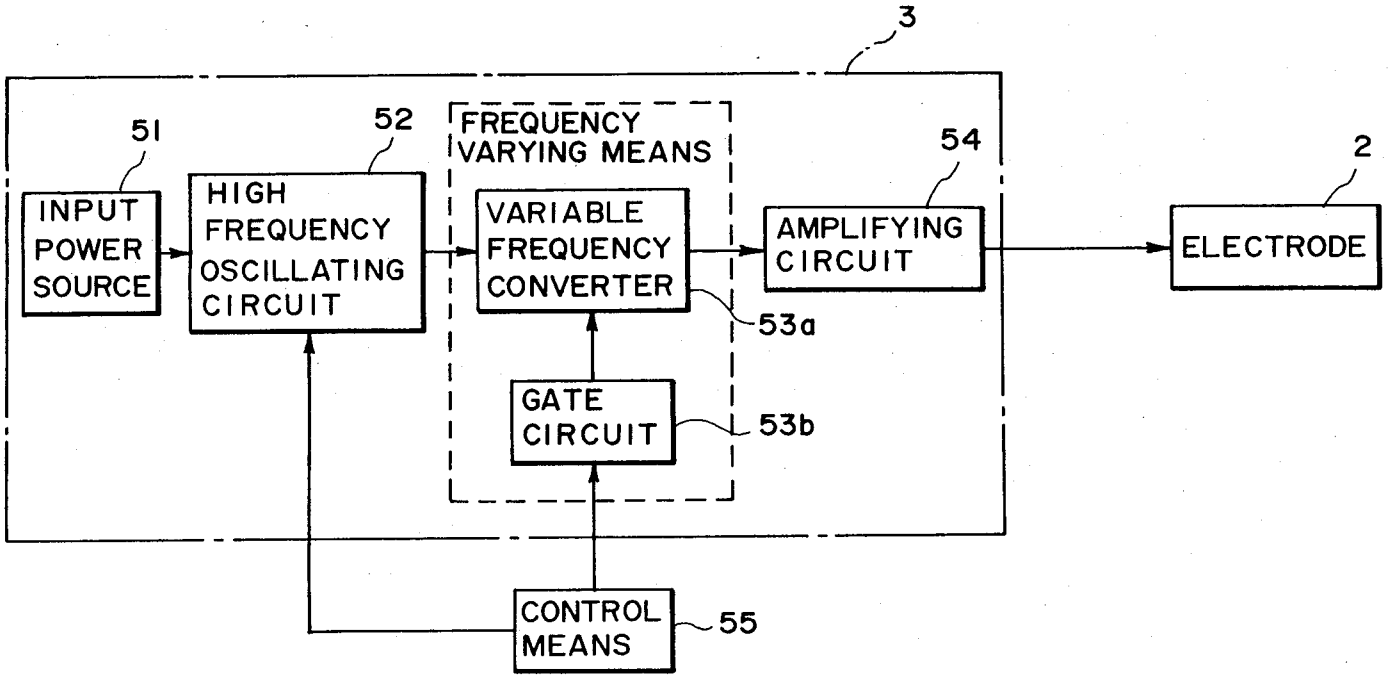
FIG. 18 is a block diagram showing still another arrangement of the high frequency voltage changing circuit.

In an arrangement shown in FIG. 18, a variable frequency converter **53*a* known to those skilled in the art is arranged between a high frequency oscillating circuit 52 for receiving power from an input power source 51 and an amplifying circuit 54 in the high frequency wave applying means 3. A gate circuit 53*b* connected to the variable frequency converter 53*a* is controlled by a control means 55 such as a microcomputer together with the high frequency oscillating circuit 52. The high frequency wave output having the same level as that in stable lighting is applied, thereby pre-heating the tube in initial lighting. The tube wall is pre-heated to the temperature or higher of the projected portion 4. Thereafter, a low frequency voltage is applied to the electrode 2**.

In this state, when the lighting signal is input to the electrode 2, the high frequency voltage enough to discharge the discharge tube 1 is applied to the electrode 2, thereby discharging the discharge tube 1. In this case, before and after lighting of the discharge tube, a portion having the lowest temperature in the tube wall temperatures of the discharge tube 1 is set to be that of the projected portion 4. Therefore, the quantity of light during lighting is the maximum quantity of light determined by the temperature of the projected portion 4.

Figure 19:
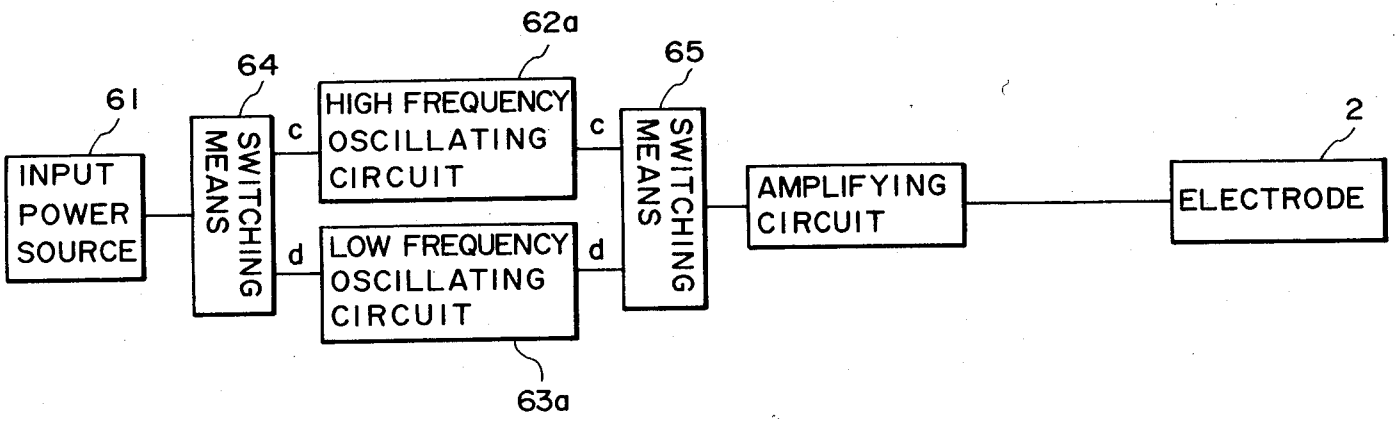
FIG. 19 is a block diagram showing still another arrangement of the high frequency voltage changing circuit.
Figure 20:
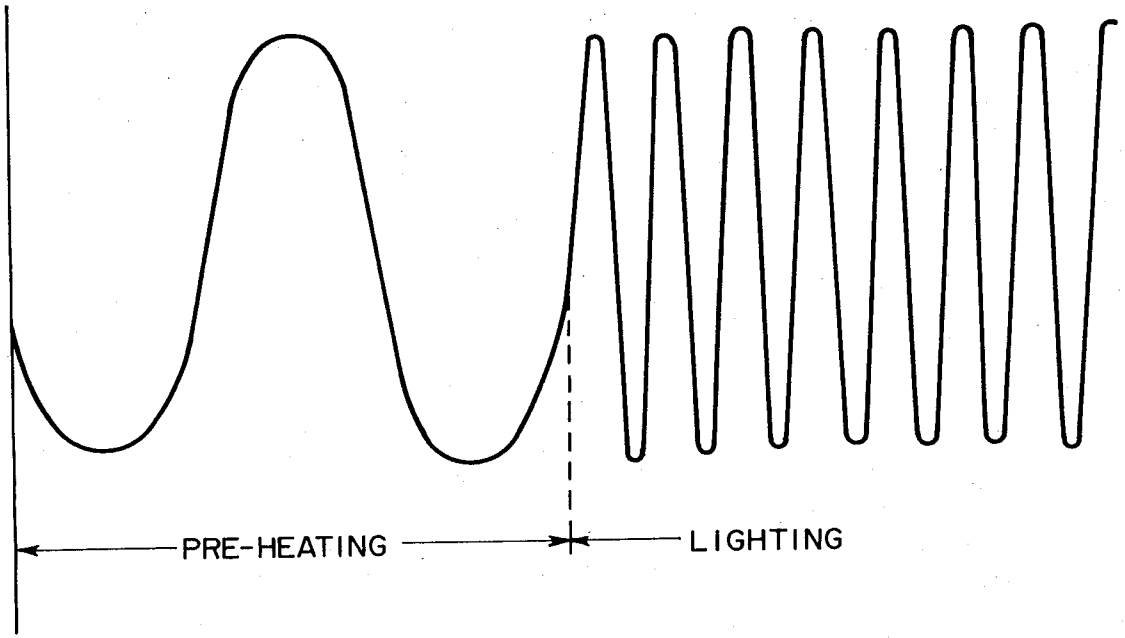
FIG. 20 is an output waveform chart of the circuit shown in FIG. 19.

In the above embodiment, the gate circuit **53*b* connected to the variable frequency converter 53*a* is controlled to vary the high frequency wave voltage to a predetermined frequency in pre-heating. However, as shown in FIG. 19, the high frequency wave applying means 3 may comprise a low voltage oscillating circuit 62*b* and a high voltage oscillating circuit 63*b*, a switching means 64 connected to the inputs of the oscillating circuits 62*b* and 63*b*, a switching means 65 connected to the outputs of the oscillating circuits 62*b* and 63*b*, an input power source 61 connected to the input of the switching means 64, and an amplifying circuit connected to the output the switching means 65. As shown in FIG. 20, in the preheating mode, a transmission path c on the side of low voltage oscillating circuit 62*b* is enabled. However, in lighting of the discharge tube, a transmission path d on the side of the high voltage oscillating circuit 63*b* is enabled. When the low voltage is applied to the electrode 2 in the pre-heating mode, the application time is prolonged as compared with the case of FIG. 18**. However, the discharge tube is not accidentally lit in the standby mode.

An arrangement for changing high frequency power by changing a duty ratio will be described below.

Figure 21:
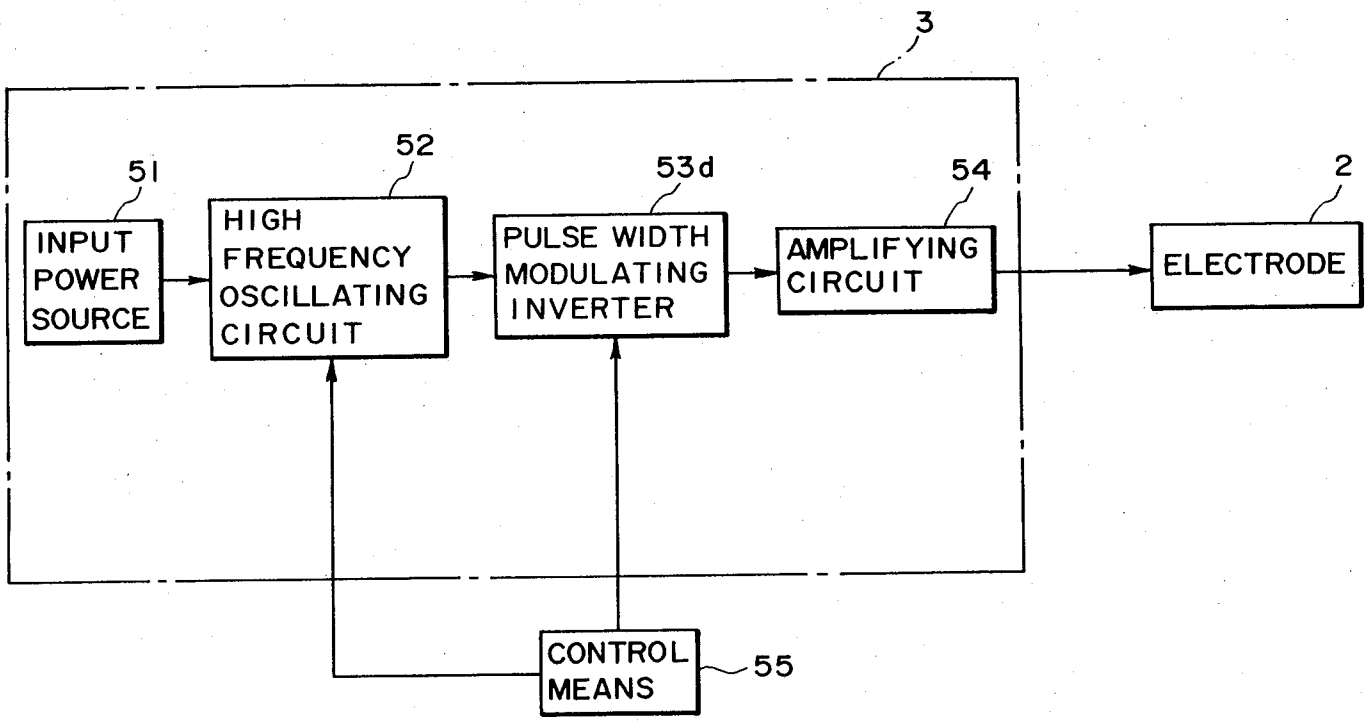
FIG. 21 is a block diagram showing still another arrangement of the high frequency voltage changing circuit.

In an arrangement shown in FIG. 21, a pulse width modulating inverter **53*d* having a PWM function known to those skilled in the art is arranged between a high frequency oscillating circuit 52 for receiving power from an input power source and an amplifying circuit 54 in the high frequency wave applying means 3. The inverter 53*d* is controlled by a control means 55 such as a microprocessor together with the high frequency oscillating circuit 52. A high frequency wave output having the same duty ratio as in stable lighting is applied to the electrode 2 to pre-heat the tube wall so that the tube wall temperature reaches the temperature of the projected portion 4** or higher. Thereafter, preheating of the tube continues with a voltage having a smaller duty ratio (discharge does not occur). The temperature of the discharge tube is maintained.

In this state, when the lighting signal is input to the electrode 2, a high frequency wave voltage enough to cause the discharge tube 1 to discharge is applied. Therefore, the discharge tube 1 is lit. In this case, before and after lighting of the discharge tube 1, the portion having the lowest temperature in the tube wall temperatures of the tube 1 is set to be equal to the temperature of the projected portion 4. The quantity of light emitted in lighting of the tube is the maximum quantity of light determined by the temperature of the projected portion 4.

In pre-heating, the voltage having a duty ratio smaller than that in stable lighting may be continuously applied to the electrode 2. In this case, the pre-heating time for heating the tube wall to the temperature of the projected portion 4 is prolonged. However, the discharge tube is not accidentally lit in the standby mode.

The arrangement for changing the duty ratio is most stable as the means for varying the high frequency power. In addition, fine adjustment can be easily performed.

The illumination apparatus according to the present invention will be described in more detail wherein the illumination apparatus is used as an exposing means in an original reading system in an electrophotographic copying machine.

Figure 22:
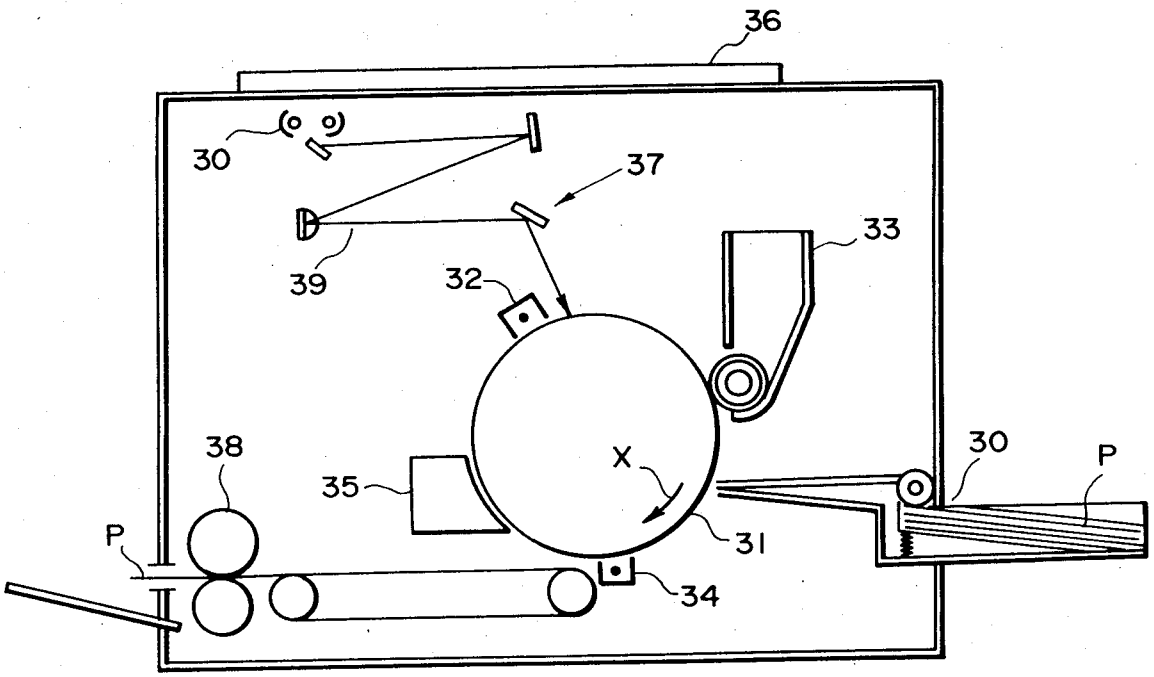
FIG. 22 is a sectional view of a copying machine to which the present invention is applied.

As shown in FIG. 22, in the electrophotographic copying machine, a photosensitive drum 31 is rotatable in a direction indicated by arrow X. Electrophotographic image forming means known to those skilled in the art, i.e., a charging means 32, a developing means 33, a transfer charging means 34, and a cleaning means 35 are arranged around the photosensitive drum 31.

An original table 36 is arranged in the upper portion of the copying machine. An exposing means 37 is arranged below the original table 36. The exposing means 37 comprises an illumination apparatus 30 of the above embodiment and a known optical system 39 for projecting an optical image of an original illuminated by the illumination apparatus 30 onto the photosensitive drum 31 uniformly charged by the charging means 32. A means for reading the original image may be a so-called original table moving reader which moves the original table to scan the original image or a so-called original table stationary reader which moves the optical system 39.

With the above arrangement, a latent image formed on the photosensitive drum 31 by the charging means 32 and the exposing means 37 is visualized by the developing means 33. The visible or toner image is transferred by the transfer charging means 34 to a transfer sheet P fed by a paper feeder 40. The transfer sheet P is then separated from the photosensitive drum 31 and is fixed by a fixing unit 38. Meanwhile, the residual toner particles on the photosensitive drum 31 are removed by the cleaning means 35, and the photosensitive drum 31 is ready for the next image formation process.

Figure 23:
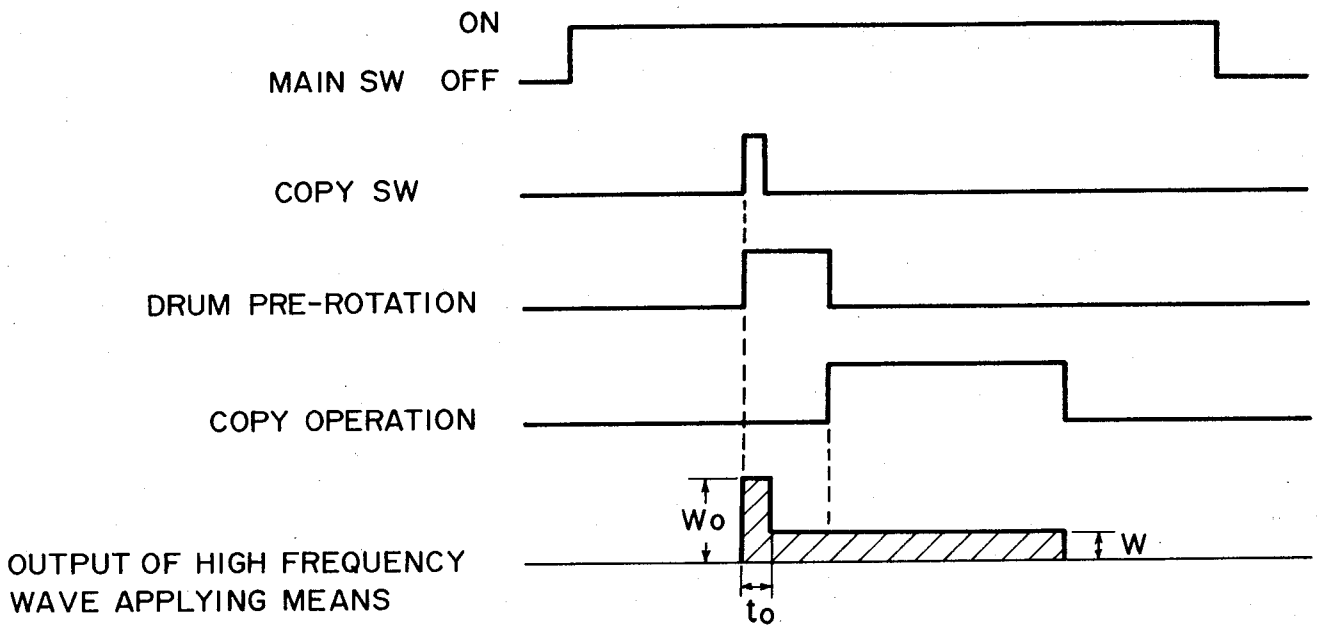
FIGS. 23 and 24 are timing charts for explaining operations of the copying machine incorporating the high frequency voltage changing circuit.

The operation of the copying machine incorporating the illumination apparatus according to the present invention will be described with reference to the timing chart in FIG. 23. When the main switch of the copying machine is turned on, the copying machine is set in the copying operation ready state (i.e., the standby state). When the copy switch is depressed (starting of original reading), the photosensitive drum 31 is pre-rotated, and other electrophotographic image forming means excluding the illumination apparatus 30 are turned on, thereby completing preparation for copy operations. When the copy operation is started, the illumination apparatus 30 is turned on. In the initial lighting state, in order to stably and accurately illuminate the discharge tube, the high frequency wave output from the figh frequency wave applying means in the illumination apparatus has a voltage equal to or higher than the voltage in stable lighting of the discharge lamp so as to light the discharge tube throughout its longitudinal area. Thus, the discharge tube wall is rapidly heated to a temperature higher than the minimum temperature portion. In general, power $W_o$ in initial lighting is suitably one to three times the supply power W of stable lighting. However, the power $W_o$ varies depending on the dimensions (diameter, length, etc.) of the discharge tube and the magnitude of power supply in stable lighting.

The high frequency wave output in initial lighting is decreased to the high frequency wave output in stable lighting immediately after the discharge tube 1 is lit. However, the initial high frequency wave output is several milliseconds to 2 or 3 seconds. The supply time $t_o$ (FIG. 23) of the initial high frequency wave output $W_o$ varies depending on the dimensions (diameter, length, etc.) of the discharge tube, the magnitude of the high frequency output W of stable lighting, and the magnitude of the initial high frequency wave output $W_o$.

Figure 24:
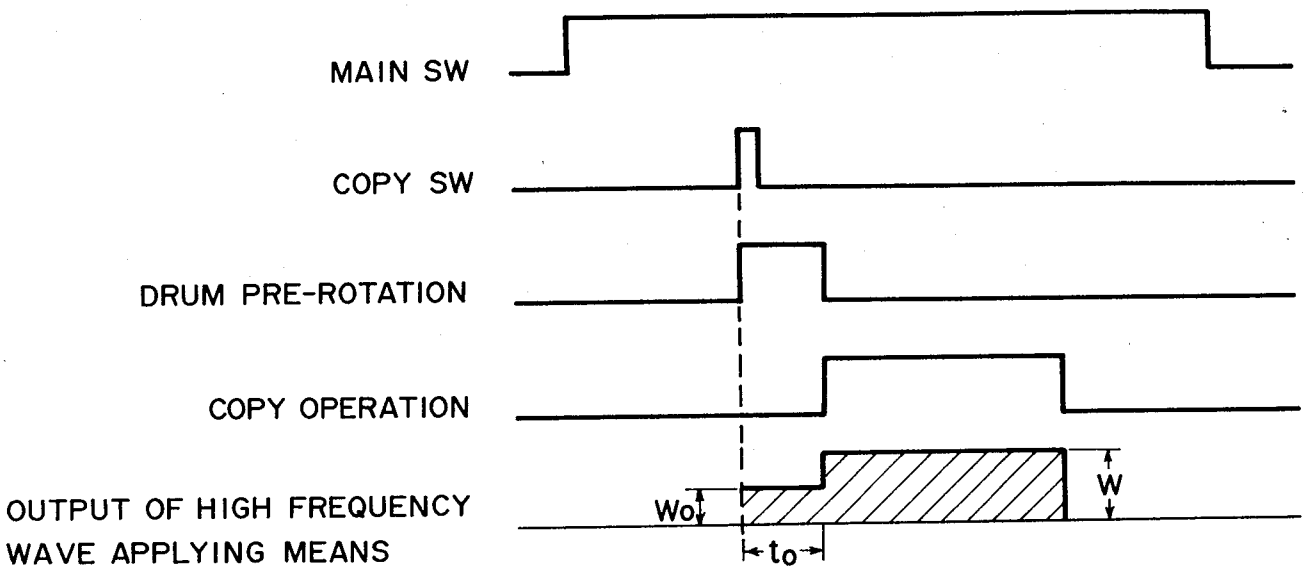

The tube wall temperature of the illumination apparatus, i.e., the discharge tube can be heated to the minimum temperature of the projected portion within a few seconds. The discharge tube can be it at the saturated vapor pressure for obtaining the maximum quantity of light determined by the temperature of the minimum temperature portion. When the high frequency wave voltage applied in the standby state is maintained at a level lower than that of stable lighting, as shown in FIG. 24, the heating temperature t0 is prolonged as compared with the case of FIG. 23.

The present invention is not limited to the particular embodiments described above. Various changes and modifications may be made within the spirit and scope of the invention.

What we claim is:

1. An illumination apparatus comprising:

a discharge tube for emitting light upon an application of a external high frequency wave electromagnetic field;

an electrode, arranged outside said discharge tube, for applying the high frequency wave electromagnetic field to said discharge tube;

high frequency wave applying means for supplying high frequency wave power to said electrode;

a projected portion extending from said discharge tube; and a metal shielding member disposed between said projected portion and said discharge tube, said shielding member substantially shielding said projected portion from the high frequency wave electromagnetic field.

2. An apparatus according to claim 1, wherein said discharge tube comprises an elongated tube, and said projected portion extends from one end of said discharge tube.

3. An apparatus according to claim 1, wherein said discharge tube contains mercury as a discharge initiator.

4. An illumination apparatus comprising:

a discharge tube for emitting light upon an application of an external high frequency wave electromagnetic field;

an electrode, arranged outside said discharge tube, for applying the high frequency wave electromagnetic field to said discharge tube;

high frequency wave applying means for applying high frequency wave power to said electrode;

a projected portion extending from said discharge tube;

temperature control means for controlling a temperature of said projected portion; and a metal shielding member disposed between said projected portion and said discharge tube, said shielding member substantially shielding said projected portion from the high frequency wave electromagnetic field.

5. An apparatus according to claim 4, wherein said discharge tube comprises an elongated tube, and said projected portion extends from one end of said discharge tube.

6. An apparatus according to claim 4, wherein said discharge tube contains mercury as a discharge initiator.

7. An apparatus according to claim 4, wherein said temperature control means controls the temperature of said projected portion within a range of 30° C. to 50° C.

8. An apparatus according to claim 4, further comprising temperature detecting means for detecting a temperature of said projected portion, said temperature control means being operated on the basis of a detection result of said temperature detecting means.

9. An apparatus according to claim 8, wherein said temperature control means comprises heating means for heating said projected portion, said heating means being controlled on the basis of the detection result of said temperature detecting means.

10. An illumination apparatus comprising:

a discharge tube for emitting light upon an application of an external high frequency wave electromagnetic field;

an electrode, arranged outside said discharge tube, for applying the high frequency wave electromagnetic field to said discharge tube;

high frequency wave applying means for applying high frequency wave power to said electrode;

a projected portion extending from said discharge tube;

means for comparing a temperature of said discharge tube with a temperature of said projected portion;

means for controlling a temperature of said discharge tube in a standby state on the basis of a comparison result of said comparing means; and a metal shielding member disposed between said projected portion and said discharge tube, said shielding member substantially shielding said projected portion from the high frequency wave electromagnetic field.

11. An apparatus according to claim 10, further comprising temperature control means for controlling the temperature of said projected portion to come close to a reference value, said comparing means being arranged to compare the temperature of said discharge tube with the reference value.

12. An apparatus according to claim 10, wherein the high frequency wave power is supplied to said electrode in the standby state at a level lower than a discharge initiation level and on the basis of the comparison result, thereby controlling the temperature of said discharge tube.

13. An apparatus according to claim 12, wherein the high frequency wave power applied to said electrode in the standby state has a duty ratio smaller than that applied in stable lighting of said discharge tube.

14. An apparatus according to claim 12, wherein the high frequency wave power applied to said electrode in the standby state has a frequency lower than that applied in stable lighting of said discharge tube.

15. An apparatus according to claim 12, wherein the high frequency wave power applied to said electrode in the standby state has a voltage lower than that applied in stable lighting of said discharge tube.

16. An apparatus according to claim 10, wherein said illumination apparatus is used as an original exposing light source in an original reading system and the standby state is a state prior to original reading.

17. An apparatus according to claim 11, wherein the reference value of the temperature of said projected portion falls within a range of 30° C. to 50° C.

* * * * *

UNITED STATES PATENT AND TRADEMARK OFFICE

CERTIFICATE OF CORRECTION

PATENT NO. : 4,797,598

DATED : January 10, 1989

INVENTOR(S) : KATSUYA OIKAWA, ET AL.

It is certified that error appears in the above-identified patent and that said Letters Patent is hereby corrected as shown below:

COLUMN 4

Line 3, "exited" should read --excited--.

COLUMN 6

Line 68, "11." should read --11--.

COLUMN 7

Line 27, "the." should read --the--.

COLUMN 8

Line 6, "areformed" should read --are formed--.

COLUMN 9

Line 36, "lightig" should read --lighting--.
Line 53, "4," should read --64,--.

COLUMN 10

Line 35, "the" should

Signed and Sealed this

Seventeenth Day of July, 1990

*Attest:*

HARRY F. MANBECK, JR.

*Attesting Officer*

*Commissioner of Patents and Trademarks*

UNITED STATES PATENT AND TRADEMARK OFFICE

CERTIFICATE OF CORRECTION

PATENT NO. : 4,797,598

DATED : January 10, 1989

INVENTOR(S) : KATSUYA OIKAWA, ET AL.

It is certified that error appears in the above-identified patent and that said Letters Patent is hereby corrected as shown below:

COLUMN 12

Line 25, "it" should read --lit--.
Line 41, "a" should read --an--.